US008008998B2

(12) United States Patent
Ko et al.

(10) Patent No.: US 8,008,998 B2
(45) Date of Patent: Aug. 30, 2011

(54) WAVEGUIDE COMPRISED OF TWO WAVEGUIDE MEMBERS ASSEMBLED BY USING A POSITIONING PIN AND A POSITIONING HOLE IN THE TWO MEMBERS

(75) Inventors: Tung Yi Ko, Hsinchu (TW); Chih Jung Lin, Hsinchu (TW)

(73) Assignee: Microelectronics Technology Inc., Hsinchu (TW)

( * ) Notice: Subject to any disclaimer, the term of this patent is extended or adjusted under 35 U.S.C. 154(b) by 244 days.

(21) Appl. No.: 12/332,697

(22) Filed: Dec. 11, 2008

(65) Prior Publication Data

US 2010/0026423 A1 Feb. 4, 2010

(30) Foreign Application Priority Data

Jul. 29, 2008 (TW) ..... 97213387 U

(51) Int. Cl.
*H01P 3/12* (2006.01)

(52) U.S. Cl. ..... 333/248; 333/254

(58) Field of Classification Search ..... 333/239, 333/248, 254
See application file for complete search history.

(56) References Cited

U.S. PATENT DOCUMENTS

| | | | | |
|---|---|---|---|---|
| 2,155,508 | A * | 4/1939 | Schelkunoff | 333/242 |
| 2,381,367 | A * | 8/1945 | Quayle | 138/128 |
| 3,076,159 | A * | 1/1963 | Vaughan et al. | 333/255 |
| 4,020,875 | A * | 5/1977 | Akiba | 138/128 |
| 6,560,850 | B2 * | 5/2003 | St. John et al. | 29/600 |
| 2006/0214751 | A1 * | 9/2006 | Leadley-Brown et al. | 333/254 |

* cited by examiner

*Primary Examiner* — Benny Lee
(74) *Attorney, Agent, or Firm* — WPAT, P.C.; Anthony King

(57) ABSTRACT

A waveguide includes a first waveguide member and a second waveguide member. The second waveguide member is combined with the first waveguide member to form a through hole. The first waveguide member includes a first shell and two first wing portions connected to the first shell, and the two first wing portions form a first plane. The second waveguide member includes a second shell and two second wing portions connected to the second shell, and the two second wing portions form a second plane. Bulged strips are formed at the inner rims of the second plane neighboring the through hole and extend along a longitudinal direction of the through hole, and the bulged strips protrude the second plane.

11 Claims, 3 Drawing Sheets

WAVEGUIDE COMPRISED OF TWO WAVEGUIDE MEMBERS ASSEMBLED BY USING A POSITIONING PIN AND A POSITIONING HOLE IN THE TWO MEMBERS

BACKGROUND OF THE INVENTION (A) Field of the Invention

The present invention is related to a waveguide, and more specifically, to a waveguide for satellite antenna signal transmission.

(B) Description of Related Art

For an ordinary satellite antenna communication system, the front end of the ground station uses the filter of a waveguide to separate the transmission signals and the receiving signals. Because the waveguide can reduce insertion loss for both transmission and receiving signals, optimal radiation power and receiving noise figure can be obtained.

For a known high frequency satellite communication apparatus, a waveguide receives satellite signals through a waveguide output/input end, and the signals are transmitted to a receiving end through the waveguide and sequentially transmitted to an analog processing device. For the transmission route, the waveguide receives the signals from an analog processing device of a radiation end, and the signals are transmitted to the waveguide output/input end for radiation.

To meet the manufacturing demands, two separated members are made through molding, and then are combined using screws to form a hollow waveguide. In addition to the use of screws, the two separated members are sealed with glue to avoid signal leakage, thereby increasing the quality of signal transmission. According to a known method, grooves are formed in the two separated members along the longitudinal direction of the waveguide, and glue is applied to the grooves by dispensing before combining the two separated members. However, the glue easily overflows after combining the separated members, and the overflow is easily pulled or dragged during sequential processing. Consequently, the original structure is damaged. Moreover, if the flatness of the combination plane of the two separated members is compromised, the quality of the seal after combination will be impacted, and as a result signal leakage and low quality of waterproofing may occur.

SUMMARY OF THE INVENTION

The present invention provides a waveguide for satellite antenna signal transmission so as to prevent the overflow of glue when combining the members of the waveguide and the damage to the structure caused by pulling or dragging the overflow during sequential processing.

According to the present invention, a waveguide includes a first waveguide member and a second waveguide member. The second waveguide member is combined with the first waveguide member to form a through hole. The first waveguide member includes a first shell and two first wing portions connected to the first shell, and the two first wing portions form a first plane. The second waveguide member includes a second shell and two second wing portions connected to the second shell, and the two second wing portions form a second plane. Bulged strips are formed at the inner rims of the second plane neighboring the through hole and extend along a longitudinal direction of the through hole, and the bulged strips protrude on the second plane.

In an embodiment, two ends of the first waveguide member and the second waveguide member may include flanges that form a flange structure after the first waveguide member and the second waveguide member are combined. The flanges include the second plane, and the bulge strip extends to the second plane of the flanges of the second waveguide member.

DETAILED DESCRIPTION OF THE INVENTION

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
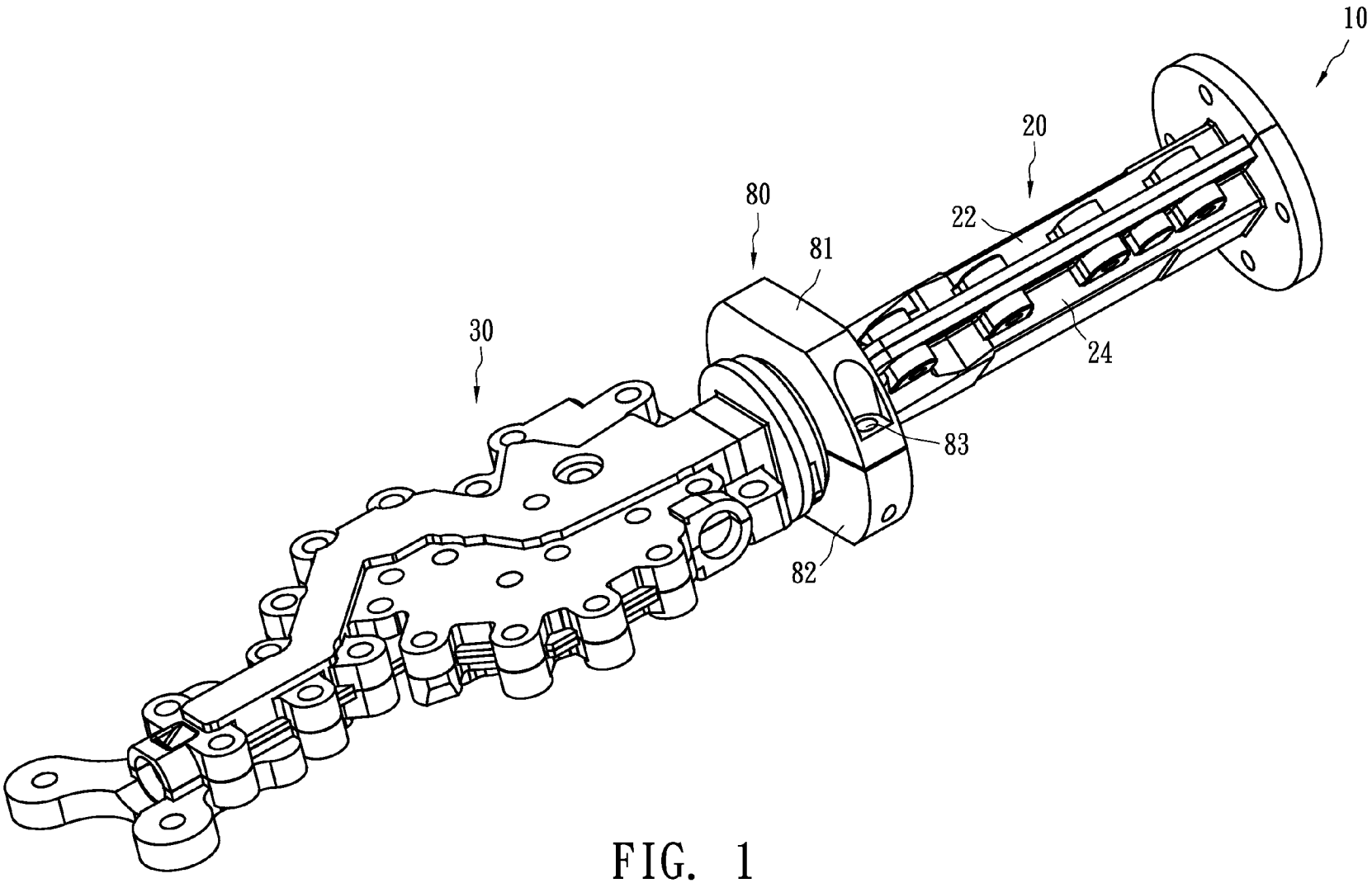
FIG. 1 shows a waveguide apparatus in accordance with the present invention.

FIG. 1 shows a waveguide apparatus 10 of a satellite antenna communication system including a waveguide 20 and a wave director 30. The waveguide 20 and the wave director 30 are combined by a clamp 80. The clamp 80 includes two separated clamp members 81 and 82 that can be secured to each other by inserting screws in the screw holes 83. The waveguide 20 is combined by two separated members including a first waveguide member 22 and a second waveguide member 24. The detail of the first waveguide member 22 is shown in FIG. 2A and FIG. 2B, and the detail of the second waveguide member 24 is shown in FIG. 3A and FIG. 3B.

Figure 2A:
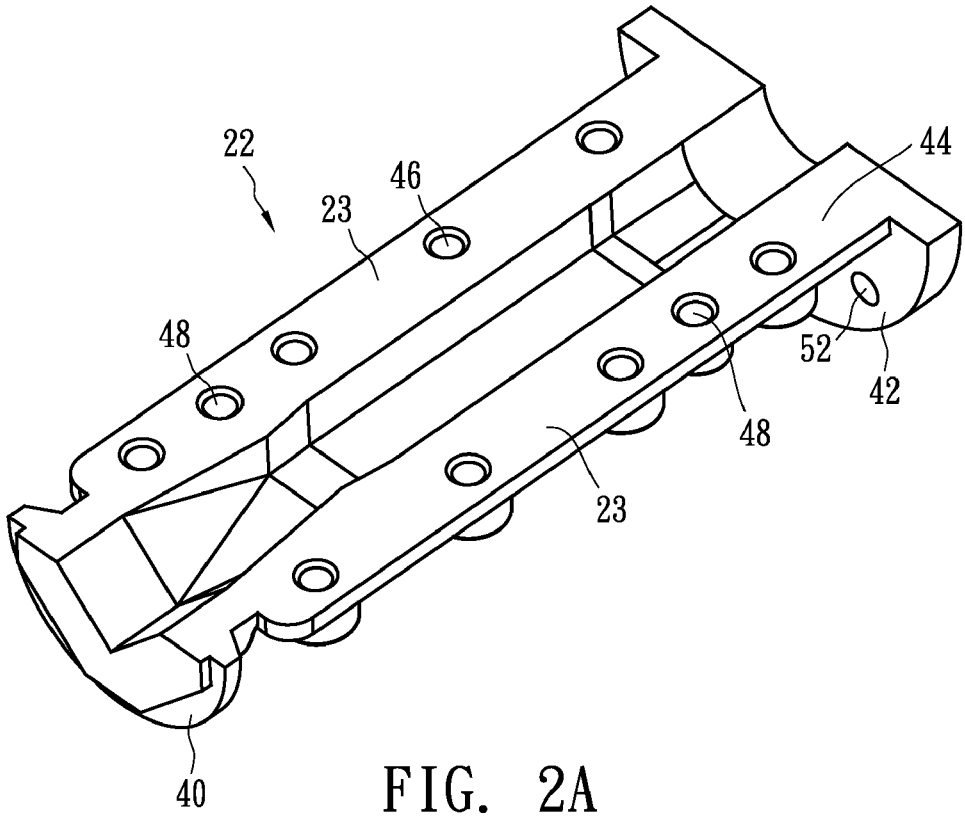
FIG. 2A and FIG. 2B show a first waveguide member of the waveguide in accordance with the present invention.
Figure 2B:
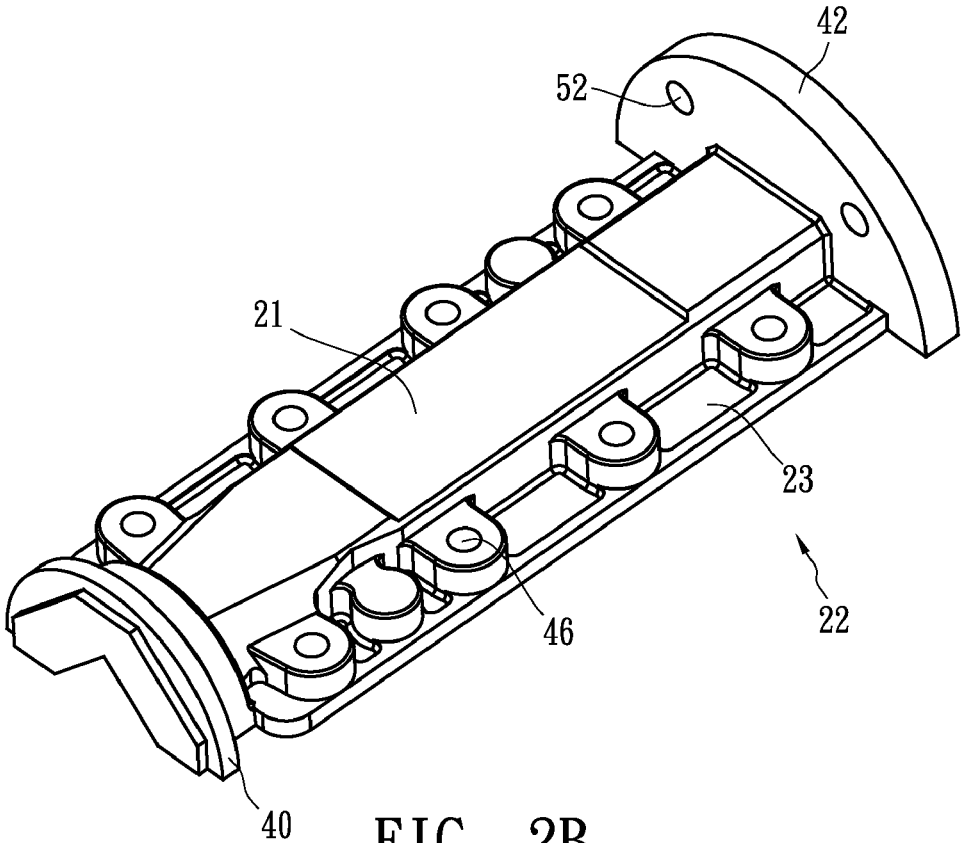

Please refer to FIG. 2A and FIG. 2B, which shows the first waveguide member 22. FIG. 2B shows the upside-down view of the member 22 in FIG. 2A. The first waveguide member 22 includes a shell 21 (FIG. 2B), two wing portions 23, a flange 40 and a flange 42. A groove is formed in the inner surface of the shell 21, and the two wing portions 23 are connected to two sides of the shell 21 and extend outwards. The flange 40 is connected to an end of the shell 21, whereas the flange 42 is connected to another end of the shell 21. The flange 40 has a polarization design, and the flange 42 includes screw holes 52. The two wing portions 23 and the upper surfaces of the flange 40 and the flange 42 form a plane 44 (FIG. 2A), i.e., the flange 40 and the flange 42 also include the plane 44. A plurality of screw holes 46 are substantially placed on the wing portions 23 with equal spans for combining the first waveguide member 22 and the second waveguide member 24. The wing portions 23 further include positioning holes 48 (FIG. 2A) for the alignment of the first waveguide member 22 and the second waveguide member 24 when assembling the first waveguide member 22 and the second waveguide member 24.

Figure 3A:
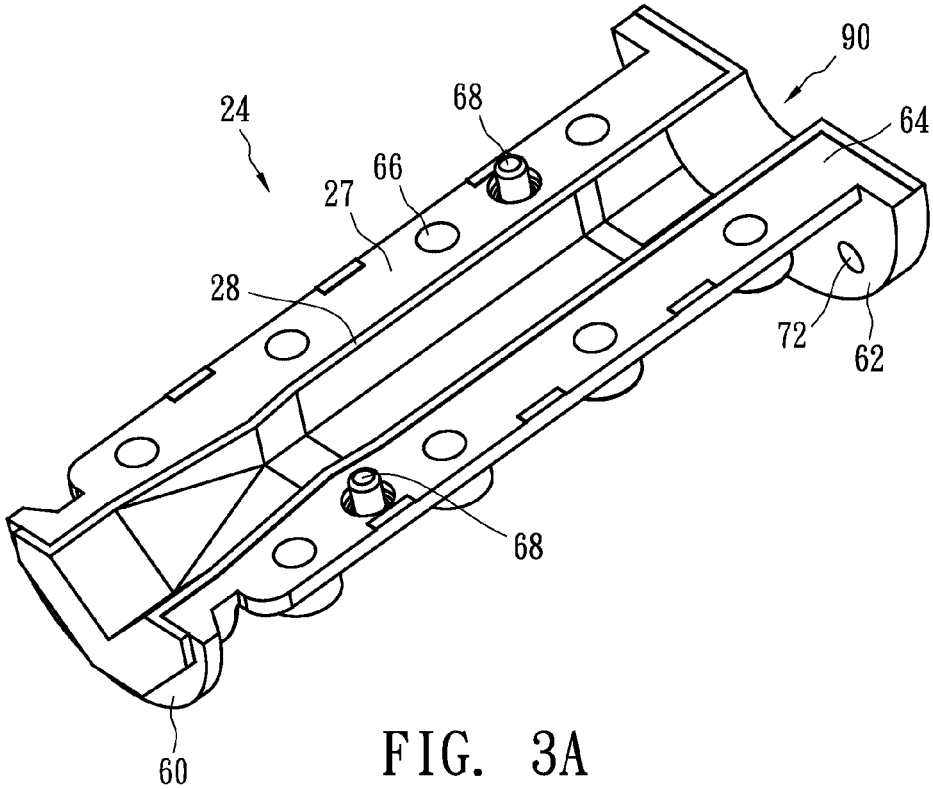
FIG. 3A and FIG. 3B show a second waveguide member of the waveguide in accordance with the present invention.
Figure 3B:
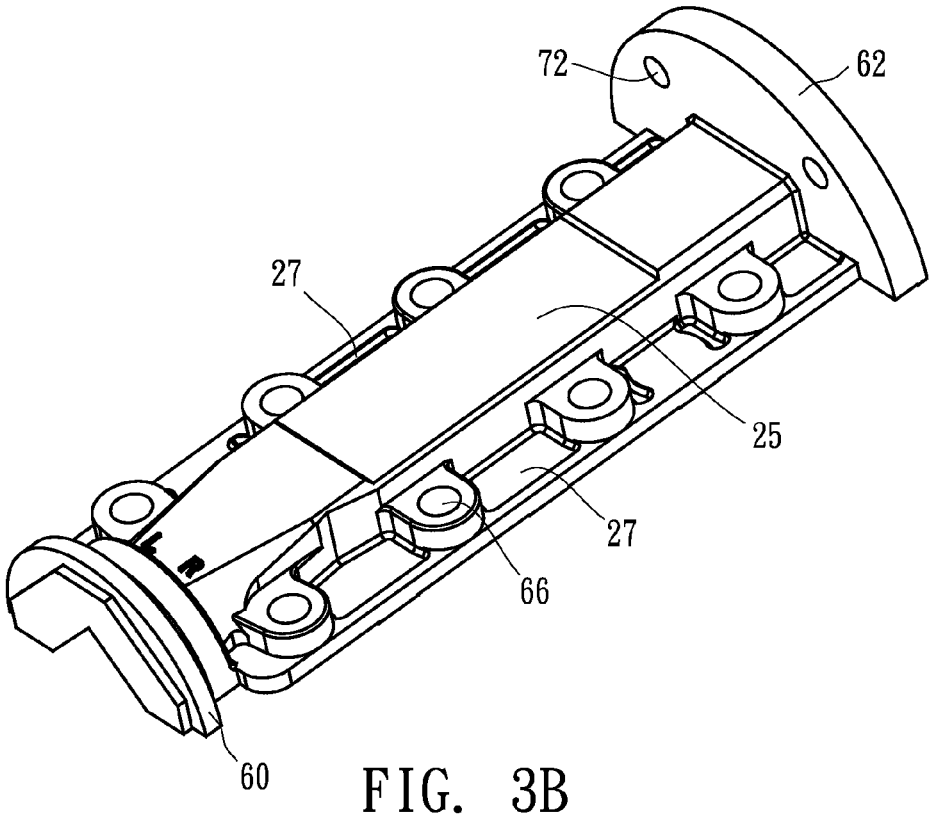

Please refer to FIG. 3A and FIG. 3B, which show the second waveguide member 24 (FIG. 3A). FIG. 3B shows the upside-down view of the member 24 in FIG. 3A. The second waveguide member 24 includes a shell 25 (FIG. 3B), two wing portions 27, a flange 60 and a flange 62. A groove is formed in the inner surface of the shell 25, and the two wing portions 27 are connected to two sides of the shell 25 and extend outwards. The flange 60 is connected to an end of the shell 25, whereas the flange 62 is connected to another end of the shell 25. The flange 60 has a polarization design, and the flange 62 includes screw holes 72. The two wing portions 27 and the upper surfaces of the flange 60 and the flange 62 form a plane 64 (FIG. 3A), i.e., the flange 60 and the flange 62 also include the plane 64. A plurality of screw holes 66 are substantially placed on the wing portions 27 with equal spans, which correspond to the screw holes 46 of the first waveguide member 22, for combining the first waveguide member 22 and the second waveguide member 24. The wing portions 27 further include positioning pins 68 (FIG. 3A) that correspond to the positioning holes 48 of the first waveguide portion 22 for the alignment of the first waveguide member 22 and the second waveguide member 24 while assembling.

After the first waveguide member 22 and the second waveguide member 24 are combined, a through hole 90 (FIG. 3A) is formed. The flange 40 and the flange 60 form a hollow round flange structure in which the hollow portion is square-shaped, and the flange 42 and the flange 62 form a hollow round flange structure in which the hollow portion is round-shaped. Referring to FIG. 1 again, the flange structure formed by combining the flange 40 and the flange 60 can be combined with the wave director 30 by using the clamp 80.

The wing portions 27 are provided with bulged strips 28 (FIG. 3A) at the inner rims of the plane 64 neighboring the through hole 90 and extend along a longitudinal direction of the through hole 90, and two ends of the bulged strip 28 perpendicularly turn to the second plane 64 on the flange 60 and the flange 62. In other words, the bulged strips 28 along the longitudinal direction on the wing portions 27 and the flange 60 or 62 are perpendicular. In an embodiment, the bulged strip 28 slightly protrudes on the second plane 64 by 0.05 to 1.0 millimeters, and the width of the bulged strip 28 is around 0.5 to 3 millimeters.

Before combining the first waveguide member 22 and the second waveguide member 24, glue, e.g., epoxy or silicone, is daubed on the plane 44 and/or the plane 64. Moreover, because the bulged strip 28 (FIG. 3A) is higher than the plane 64 to a small extent, a decrease in the flatness of the plane 64 can be tolerated. As a result, the first waveguide member 22 and the second waveguide member 24 can be combined more tightly, and the gap therebetween can accommodate glue so as to avoid overflow occurrence in the through hole 90. Therefore, after the first waveguide member 22 and the second waveguide member 24 are combined, the sequential machining for improving the flatness of the flanges 40 and 60, or flanges 42 and 62 will not pull or drag the overflow and damage original structure.

The design of the bulged strip can improve the seal performance of the waveguide so as to improve waterproof efficacy. In an embodiment, the bulged strip extends to the flanges at two ends of the waveguide, so as to further improve waterproof efficacy and the quality of signal transmission.

The above-described embodiments of the present invention are intended to be illustrative only. Numerous alternative embodiments may be devised by those skilled in the art without departing from the scope of the following claims.

What is claimed is:

1. A waveguide, comprising:

a first waveguide member, comprising:

a first shell; and two first wing portions connected to the first shell, and the two first wing portions defining a first plane; and a second waveguide member in combination with the first waveguide member to provide a through hole for the waveguide, comprising:

a second shell; and two second wing portions connected to the second shell, the two second wing portions defining a second plane, wherein bulged strips are disposed at inner rims of the second plane adjacent to the through hole and extend along a longitudinal direction of the through hole, and the bulged strips protrude on the second plane toward the first wing portions, wherein the first wing portion comprises at least one positioning hole, the second wing portion comprises at least one positioning pin corresponding to the positioning hole for alignment of the first waveguide member and the second waveguide member.

2. The waveguide of claim 1, wherein an end of the first waveguide member has a first flange, an end of the second waveguide member has a second flange, the second flange comprises the second plane, the first flange and the second flange collectively provide a first flange structure, and the bulged strips extend to the second plane of the second flange.

3. The waveguide of claim 2, wherein another end of the first waveguide member has a third flange, another end of the second waveguide member has a fourth flange, the fourth flange comprises the second plane, the third flange and the fourth flange collectively provide a second flange structure, and the bulged strips extend to the second plane of the fourth flange.

4. The waveguide of claim 3, wherein the bulged strips on the second wing portion and the fourth flange are perpendicular to each other.

5. The waveguide of claim 2, wherein the bulged strips on the second wing portion and the second flange are perpendicular to each other.

6. The waveguide of claim 2, wherein the first flange structure is combined with a wave director.

7. The waveguide of claim 6, wherein the first flange structure and the wave director are combined by a clamp.

8. The waveguide of claim 1, wherein the first wing portion comprises a plurality of first screw holes, the second wing portion comprises a plurality of second screw holes corresponding to the first screw holes, and the first screw holes and the second screw holes are arranged along the longitudinal direction of the through hole for the waveguide with substantially equal spans for joining the first waveguide member and the second waveguide member.

9. The waveguide of claim 1, wherein the first waveguide member and the second waveguide member are joined by glue comprising epoxy or silicone.

10. The waveguide of claim 1, wherein the bulged strip protrudes on the second plane in the range of 0.05 to 1 millimeters.

11. The waveguide of claim 1, wherein the bulged strip has a width in the range of 0.5 to 3 millimeters.

* * * * *